US005318150A

United States Patent [19]

Donaho

[11] Patent Number: 5,318,150

[45] Date of Patent: Jun. 7, 1994

[54] SAWHORSE AND END SUPPORT THEREFOR

[76] Inventor: John F. Donaho, P.O. Box 38, Riviera, Tex. 78379

[21] Appl. No.: 914,456

[22] Filed: Jul. 17, 1992

[51] Int. Cl.[5] ..... E04G 1/00

[52] U.S. Cl. ..... 182/181; 211/194; 248/188.8

[58] Field of Search ..... 248/188.8, 188.6, 168, 248/169, 440.1, 440; 182/153, 155, 181; 211/194

[56] References Cited

U.S. PATENT DOCUMENTS

| | | | |
|---|---|---|---|
| 1,636,342 | 7/1927 | Whelan | 182/153 |
| 2,198,956 | 4/1940 | Thielepape | 182/181 |
| 2,699,814 | 1/1955 | Kahn | 248/188.8 |
| 2,846,274 | 8/1958 | Nakano | 182/181 |
| 3,081,841 | 3/1963 | Mauro | 248/188.8 |
| 3,858,682 | 1/1975 | Larson | 182/181 X |
| 4,433,753 | 2/1984 | Watson | 182/151 |
| 4,763,757 | 8/1988 | Cheney | 182/153 X |
| 5,004,369 | 4/1991 | Young | 403/232.1 |
| 5,085,397 | 2/1992 | Henkel | 211/194 X |
| 5,101,932 | 4/1992 | Trudgeon | 182/181 X |
| 5,184,697 | 2/1992 | Crewe et al. | 182/153 |

FOREIGN PATENT DOCUMENTS

| | | | |
|---|---|---|---|
| 1100895 | 9/1955 | France | 248/188.8 |

*Primary Examiner*—David A. Scherbel
*Assistant Examiner*—Korie Chan
*Attorney, Agent, or Firm*—G. Turner Moller

[57] ABSTRACT

A sawhorse comprises a central beam and a pair of injection molded plastic end supports. The end supports each provide an upwardly facing notch for receiving a standing 2×4 acting as the beam of the sawhorse. The 2×4 is attached to the end supports by nailing to provide a fixed sawhorse or by bolting to provide a partially collapsible sawhorse. The end supports provide a maximum strength to weight ratio, are partially nestable to reduce costs during storage and transportation and provide an inexpensive, sturdy sawhorse assembly.

11 Claims, 1 Drawing Sheet

SAWHORSE AND END SUPPORT THEREFOR

This invention relates to a sawhorse and more particularly to a sawhorse comprising a pair of molded plastic end supports to which a beam, usually wooden, is attached.

Sawhorses are commonly used in the construction industry to support workpieces and for a variety of other uses. Conventional sawhorses are made by a carpenter and take a fair amount of time, effort and expertise. In an effort to provide sawhorses without the expenditure of so much time and effort, a variety of fittings having been proposed to which legs and/or a central beam are attached. It is this type device to which this invention most nearly relates. Disclosures of some interest are found in U.S. Pat. Nos. D300,251; D300,861; 1,143,397; 1,224,893; 1,408,675 and 1,597,555.

All of the prior art devices have some objection or disadvantage. Some of these end fittings are made of sheet metal which shortly begin rusting and accordingly deteriorate rapidly. Some of these devices do not produce sturdy sawhorses. Other fittings are unduly expensive.

This invention comprises an injection molded plastic end support providing a central notch sized to receive a conventional piece of lumber acting as the beam of the sawhorse. The end support provides a pair of diverging legs defining a small acute angle with the vertical. A notch, between the diverging legs, allows the assembled sawhorses to be vertically stacked. The end support is inexpensive and partially nestable.

It is an object of this invention to provide an improved end support for a saw horse.

Another object of this invention is to provide an injected molded, sturdy, inexpensive plastic end support for a sawhorse.

A further object of this invention is to provide a sawhorse incorporating an improved end support.

These and other objects of this invention will become more fully apparent as this description proceeds, reference being made to the accompanying drawings and appended claims.

IN THE DRAWINGS

Figure 1:
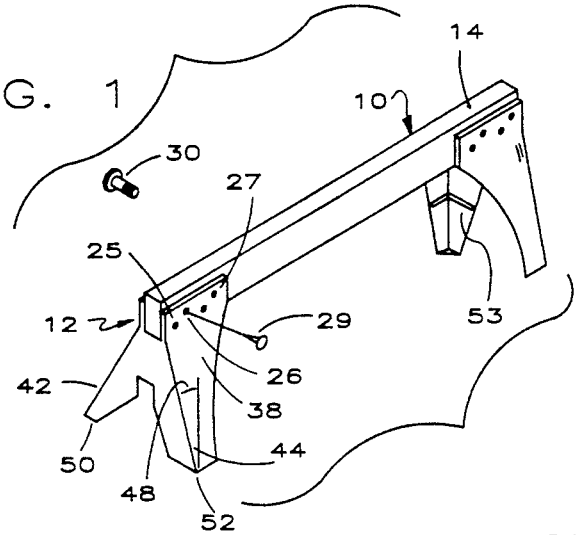
FIG. 1 is an isometric view of a sawhorse equipped with the end support of this invention.
Figure 2:
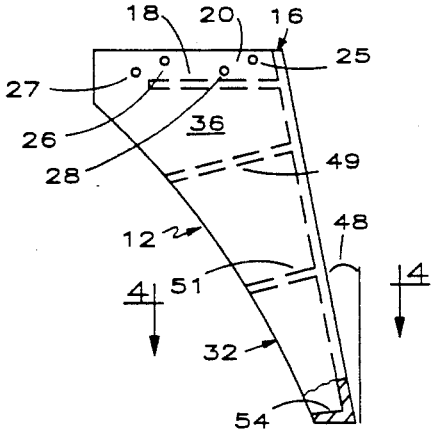
FIG. 2 is a side elevational view of the end support of FIG. 1, certain parts being broken away for clarity of illustration.
Figure 3:
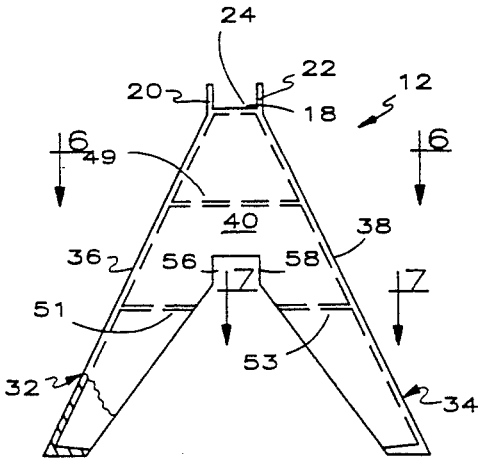
FIG. 3 is an end view of the end support of FIG. 1.
Figure 5:
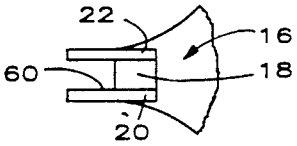
FIG. 5 is a partial top view of the end support of FIGS. 1-3.

Referring to FIGS. 1-3, a sawhorse 10 comprises a pair of end supports 12 of this invention and a central beam 14. The end supports 12 are injection molded from a high strength high impact organic polymeric material.

Preferably, this plastic has therein fibers which add strength as is well known in the art. The end supports 12 include a beam receiving section 16 comprising a horizontal wall 18 and a pair of upstanding flanges 20, 22 providing an open ended notch 24 receiving the beam 14 therein. The flanges 20, 22 may be provided with offset fastener openings 26, 28 for receiving a nail or screw 29 to secure the beam 14 in the notch 24. It will be seen that the fastener openings 26, 28 in the flange 20 are offset relative to the fastener openings in the flange 22 so the fasteners 29 do not abut and are far enough apart not to split the beam 14. The flanges 20, 22 also provide aligned fastener openings 25, 27 for receiving a bolt 30 for purposes more fully explained hereinafter.

The length of the notch 24 is selected to provide substantial support for the beam 14. The exact length of the notch 24 depends mainly on the size of the beam 14 but the notch 24 should be on the order of at least about five times the horizontal distance between the flanges 20, 22. Thus, in a typical sawhorse 10 in which the selected beam 14 is a conventional 2×4 having exact dimensions of 1 ½"×3 ½", the notch 24 is at least about seven inches long and, in a preferred embodiment, is about eight inches long. Those skilled in the art will appreciate that the cost and strength of the end support 12 both decrease as the length of the notch 24 decreases.

The depth of the notch 24 is sufficient to position the upper end of the beam 14 above the flanges 20, 22 by a suitable amount. Although this can vary widely, the beam 14 preferably extends about one inch above the flanges 20, 22. Thus, the height of the flanges 20, 22 are selected to correspond to the preferred beam. In a typical sawhorse 10 where the selected beam 14 is a conventional 2×4, the flanges 20, 22 are thus preferably about 2 ½" above the wall 18.

Extending downwardly from the wall 18 are a pair of diverging legs 32, 34. The legs 32, 34 comprise a pair of upright substantially planar inclined diverging side walls 36, 38 and a planar inclined front wall 40 joining the side walls 36, 38 along edges 42, 44 which are inclined to a vertical axis 46 by a small acute angle 48 less than about 30° and preferably less than about 20°. In side view (FIG. 2), the angle 48 has an apparent value of about 10° and, in end view (FIG. 3), the angle 48 has an apparent value of about 16°.

Figure 4:
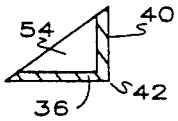
FIG. 4 is a cross-sectional view of FIG. 2, taken substantially along line 4—4 thereof as viewed in the direction indicated by the arrows.
Figure 6:
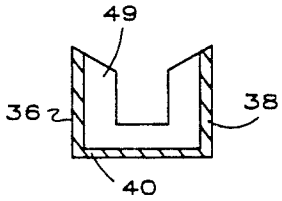
FIG. 6 is a cross-sectional view of FIG. 3, taken substantially along line 6—6 thereof as viewed in the direction indicated by the arrows.

The legs 32, 34 taper downwardly from the relatively long notch 24 into much narrower substantially identical feet 50, 52. As shown best in FIG. 4, the walls 36, 40 have the appearance of a structural angle in which the angle between the walls 36, 40 is 90° when measured in a horizontal plane. One or more gussets 49, 51, 53 may be provided for strengthening the walls 36, 40. As seen best in FIG. 6, the gusset 49 is U-shaped and the gusset 53 is L-shaped for purposes more fully apparent hereinafter. The feet 50, 52 include a triangular base 54 which is flat on the bottom bonded to the bottom of the walls 36, 40 and the bottom of the walls 38, 40 thereby rigidifying the lower wall ends. As shown best in FIG. 2 and 3, the base 54 tapers toward the rear of the legs and is thicker at the intersection of the walls 36, 40 and at the intersection of the walls 38, 40, i.e. along the edges 42, 44.

Referring to FIG. 3, another feature of the end supports 12 is illustrated. In the bight between the legs 32, 34, there is provided a notch 56 providing parallel sides 58 spaced apart a slightly greater distance than the thickness of the beam 14. The notch 56 accordingly allows vertical stacking of the finished sawhorses 10 in a sturdy manner.

Assembly of the sawhorse 10 should now be apparent. The beam 14 is preferably a piece of lumber of conventional size and length, such as a 2×4 three feet long. The beam 14 is placed edge up in the notch 24. If the user does not wish to fold the sawhorse 10, fasteners 29 are driven through the flanges 20, 22 into the beam 14.

Figure 8:
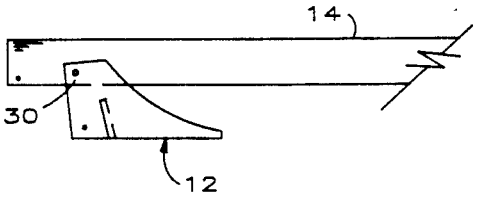
FIG. 8 is a partial view of the sawhorse of FIGS. 1-7, illustrated in a partially collapsed position.
Figure 7:
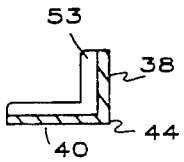
FIG. 7 is a cross-sectional view of FIG. 3, taken substantially along line 7—7 thereof as viewed in the direction indicated by the arrows.

If the user desired to provide a folding sawhorse 10, the bolts 30 are used to secure the beam 14 in place. By removing one of the bolts 30, the end supports 12 can both be folded toward the center of the beam 14 as shown in FIG. 8 providing compactness for storage or transport. As shown in FIG. 8, the horizontal wall 18 does not extend the full length of the flanges 20, 22 providing a notch 60 to clear the bottom of the beam 14 when it is pivoted about the fastener 30.

The end supports 12 are partially nestable which is very desirable during storage and transportation prior to sale to the end user. With the wall 40 of a first support 12 on a horizontal surface, the flanges 20, 22 of second support 12 fit into the U-shaped gusset 49 of the first support 12. The legs 32, 34 of the second support 12 fit in the L-shaped gussets 51, 53 of the first support 12. Thus, the partially nested supports 12 lie in a staggered thin arrangement.

If it is desired to vertically stack the assembled sawhorses 10, the bight between the legs 32, 34 is unobstructed so the beam 14 slides into the notch 56 and steadies the stacked sawhorses 10.

Although this invention has been disclosed and described in its preferred forms with a certain degree of particularity, it is understood that the present disclosure of the preferred forms is only by way of example and that numerous changes in the details of construction and operation and in the combination and arrangement of parts may be resorted to without departing from the spirit and scope of the invention as hereinafter claimed.

I claim:

1. A sawhorse comprising a pair of end supports each comprising a beam receiver including a pair of upwardly extending, facing parallel flanges providing a pair of facing inner faces defining an upwardly facing first notch and a pair of outer faces, and a pair of downwardly extending legs diverging at an acute angle and supporting the beam receiver, each of the legs having first and second wall sections joined along an inclined edge common to the first and second wall sections;

a bight at the acute angle between the diverging legs including a pair of vertical sides, the vertical sides being spaced apart a distance essentially the same as the outer faces of the parallel flanges thereby providing a second notch for closely receiving the beam of a vertically stacked sawhorse and for receiving the flanges of a vertically stacked bracket; and a planar foot including a base extending between the wall sections;

the sawhorse end supports being of a predetermined height and providing a horizontal plane bisecting the height, the second notch being between the horizontal plane and the first notch;

a wooden beam in the notch; and a plurality of fasteners extending through the flanges securing the beam in the notch.

2. The sawhorse of claim 1 wherein a first of the flanges provides a first series of fastener openings therethrough and a second of the flanges provides a second series of fastener openings therethrough offset relative to the first series of fastener openings.

3. The sawhorse of claim 1 wherein the flanges provide pairs of aligned openings therethrough and the fasteners comprise removable fasteners.

4. The sawhorse of claim 3 wherein there are at least two pairs of aligned openings and only one fastener having an axis through one of the opening pairs, the end support being pivoted about the fastener axis to juxtapose the beam.

5. The sawhorse of claim 1 wherein the first wall sections are generally parallel to the flanges and the second wall sections are generally perpendicular to the first wall section, the flanges are at least on the order of about five times longer than the distance between the flanges and the feet are much smaller than the length of the flanges, the first wall section including an upper edge joined to the flanges and a lower edge joined to the base of the foot.

6. The sawhorse of claim 5 wherein the base of the foot is tapered from a first thick end adjacent the inclined edge toward a second end, thinner than the first thick end, away from the inclined edge.

7. The sawhorse of claim 1 further comprising a U-shaped gusset extending between the first wall sections of the legs and providing a third notch having sides spaced apart at least as far as the flanges, the third notch being vertically aligned with the second notch, the U-shaped gusset being between the first and second notches.

8. The sawhorse of claim 7 further comprising an L-shaped gusset extending between the first and second wall sections of each of the legs and providing a notch for receiving the leg of a nested end support, the L-shaped gusset being between the second notch and the foot of each leg.

9. A sawhorse end support comprising a pair of upwardly extending, facing spaced apart parallel flanges providing a pair of facing inner faces defining an upwardly facing first notch therebetween and a pair of outer faces, the flanges being 5–15 times longer than the distance therebetween, and a pair of downwardly extending legs diverging at an acute angle supporting the beam receiver, each of the legs having a first wall section generally parallel to the flanges and having an upper edge joined to one of the flanges, a second wall section generally perpendicular to the first wall section and joined thereto an inclined edge common to the first and second wall sections, the second wall sections providing a bight at the acute angle between the downwardly diverging legs including a pair of vertical sides, the vertical sides being spaced apart a distance essentially the same as the outer faces of the parallel flanges thereby providing a second notch for receiving the beam of a vertically stacked sawhorse and for receiving the flanges of a vertically stacked bracket, a U-shaped gusset extending between the first wall sections of the legs at a location between the bight and the flanges and providing a third notch having sides spaced apart at least as far as the flanges, an L-shaped gusset extending between the first and second wall sections of each of the legs and providing a fourth notch for receiving the leg of a nested end support, and a planar foot including a base extending between the first and second wall sections;

the sawhorse end supports being of a predetermined height and providing a horizontal plane bisecting the height, the second notch being between the horizontal plane and the first notch.

10. The sawhorse end support of claim 9 wherein the inclined edge defines a small acute angle, less than 20°, relative to the vertical.

11. The sawhorse end support of claim 9 wherein the base of the foot is tapered from a first thick end adjacent the inclined edge toward a second end, thinner than the first thick end, away from the inclined edge.

* * * * *